US006918997B2

(12) United States Patent
Goto et al.

(10) Patent No.: US 6,918,997 B2
(45) Date of Patent: Jul. 19, 2005

(54) METHOD OF PRODUCING PULP MOLDINGS

(75) Inventors: Minoru Goto, Tochigi (JP); Keiji Eto, Tochigi (JP)

(73) Assignee: Kao Corporation, Tokyo (JP)

( * ) Notice: Subject to any disclaimer, the term of this patent is extended or adjusted under 35 U.S.C. 154(b) by 43 days.

(21) Appl. No.: 10/257,373

(22) PCT Filed: Apr. 16, 2001

(86) PCT No.: PCT/JP01/03235

§ 371 (c)(1),
(2), (4) Date: Mar. 31, 2003

(87) PCT Pub. No.: WO01/79609

PCT Pub. Date: Oct. 25, 2001

(65) Prior Publication Data

US 2003/0150583 A1 Aug. 14, 2003

(30) Foreign Application Priority Data

Apr. 18, 2000 (JP) ..... 2000-116768

(51) Int. Cl.[7] ..... D21F 13/00

(52) U.S. Cl. ..... 162/218; 162/221; 162/222; 162/226; 162/389; 162/397; 162/407; 162/409; 425/175; 425/182; 249/63; 249/65; 264/86; 264/87

(58) Field of Search ..... 162/218, 221, 162/222, 226, 389, 397, 407–409; 425/175; 249/63, 65; 264/86, 87

(56) References Cited

U.S. PATENT DOCUMENTS 2,961,043 A 11/1960 Justin et al.

FOREIGN PATENT DOCUMENTS

| | | |
|---|---|---|
| JP | 35-9669 | 7/1960 |
| JP | 38-17053 | 9/1963 |
| JP | 42-9086 | 5/1967 |
| JP | 7-3700 | 1/1995 |
| JP | 7-70999 | 3/1995 |
| JP | 8-49200 | 2/1996 |
| JP | 9-132900 | 5/1997 |
| JP | 11-342550 | 12/1999 |

*Primary Examiner*—Mark Halpern
(74) *Attorney, Agent, or Firm*—Oblon, Spivak, McClelland, Maier & Neustadt, P.C.

(57) ABSTRACT

A method of producing a pulp molded article comprising the steps of assembling splits (10, 11) each having a suction passageway and a papermaking screen (5) into a papermaking mold (1), filling the cavity of the papermaking mold (1) with a pulp slurry, discharging the liquid component of the pulp slurry through the suction passageway to deposit pulp fiber on the inner side of the papermaking screen (5) into an undried wet molded article, and dewatering the undried molded article deposited on the inner side of the papermaking screen (5), wherein the splits (10, 11) each have a large number of flow passageways (2) for feeding a purging fluid for cleaning the papermaking screen (5), and the purging fluid is ejected from the outer side of the papermaking screen (5) toward the cavity through the flow passageways (2) during the filling with the pulp slurry.

16 Claims, 8 Drawing Sheets

1
11
10
3a
3b
3c
3d
3e
2
C
P
V1
V2
V3
V4
V5
V6
7
8

(a)

1
6
C
P
8
(b)

1
6
8
8
(c)

1
6
C
P

METHOD OF PRODUCING PULP MOLDINGS

The present application corresponds to PCT International Application No. PCT/JP01/03235, filed Apr. 16, 2001.

TECHNICAL FIELD

The present invention relates to a method of producing a pulp molded article and a papermaking mold used therefor.

BACKGROUND ART

Known techniques pertinent to production of a pulp molded article include the method disclosed in JP-A-7-3700. The method involves the step of cleaning a papermaking mold apart from the line of producing a molded article, which has been a bar to improvement on production efficiency.

Accordingly, an object of the present invention is to provide a method of producing a pulp molded article and a papermaking mold used therefor which enable cleaning in the production line and therefore bring about marked improvement on production efficiency.

DISCLOSURE OF THE INVENTION

The present invention accomplishes the above object by providing a method of producing a pulp molded article comprising the steps of assembling a plurality of splits each having a papermaking screen and a suction passageway into a papermaking mold, filling the cavity of the papermaking mold with a pulp slurry, discharging the liquid component of the pulp slurry through the suction passageway to deposit pulp fiber on the inner side of the papermaking screen into an undried wet molded article, and dewatering the undried molded article deposited on the inner side of the papermaking screen, which is characterized in that the splits each have one or more flow passageways for feeding a purging fluid for cleaning the papermaking screen and that the purging fluid is fed from the outer side of the papermaking screen toward the cavity through the flow passageways during the filling with the pulp slurry.

The present invention also accomplishes the above object by providing a papermaking mold for pulp molded article production which is used to carry out the above-described method of producing a pulp molded article and which is assembled from a plurality of splits to form a cavity, wherein the splits each have one or more flow passageways for a purging fluid that interconnect the cavity and the outside, a suction passageway for sucking the liquid component of the pulp slurry charged into the cavity, a papermaking screen trapping the solid component of the pulp slurry, and a feed pipe line for feeding the purging fluid which connects to the flow passageway, the feed pipe line having a valve which turns on and off under control so as to feed the purging fluid toward the cavity during the filling with the pulp slurry.

BEST MODE FOR CARRYING OUT THE INVENTION

Figure 1:
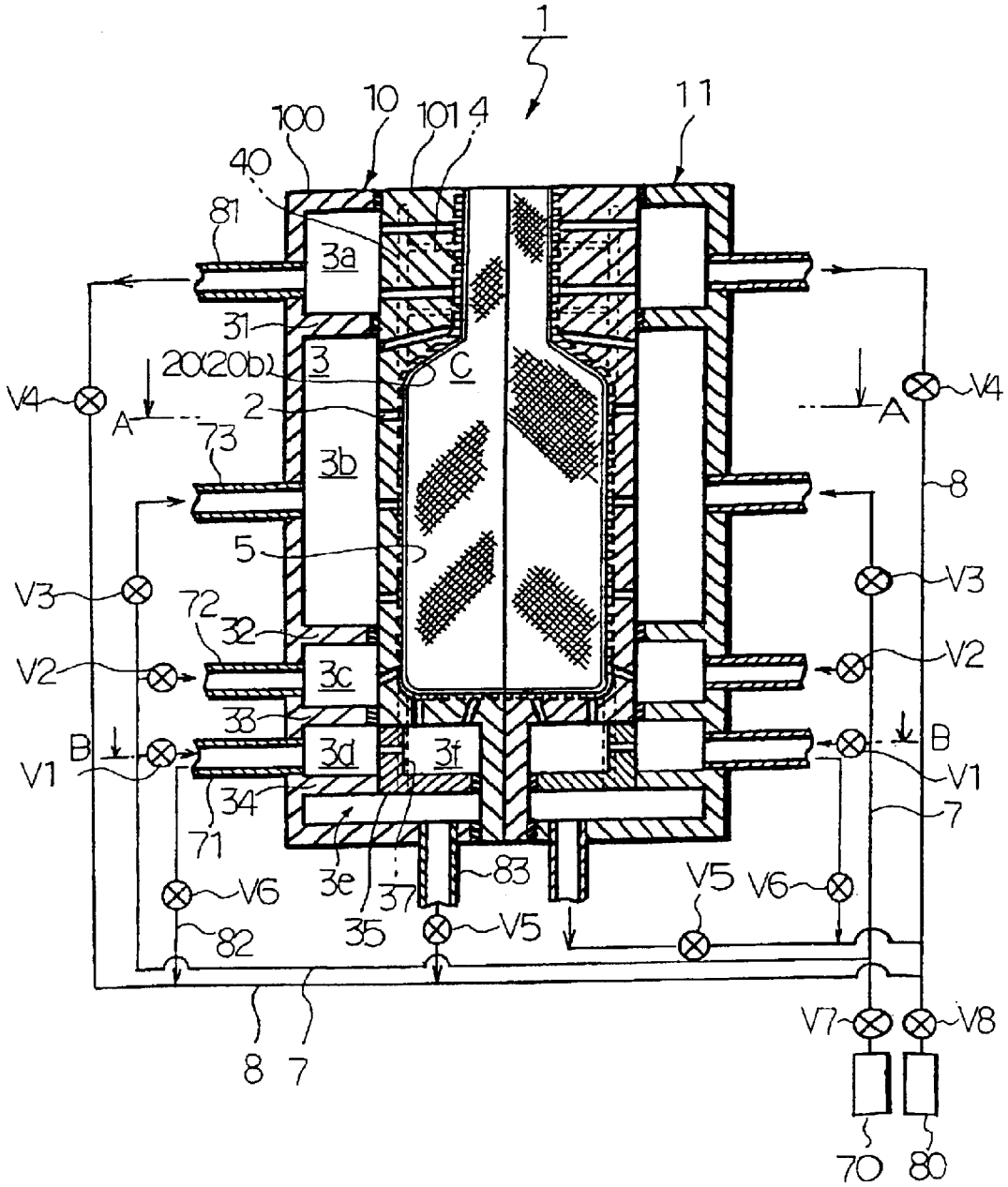
FIG. 1 is a schematic cross-section of splits assembled into a papermaking mold, representing one embodiment of the papermaking mold for pulp molded article production according to the present invention.

The present invention will be described based on its preferred embodiments with reference to the accompanying drawings. FIG. 1 represents an embodiment of splits forming the papermaking mold used in the method of producing a pulp molded article according to the present invention. In FIG. 1, numerical reference 1 indicates the papermaking mold; 7, a feed pipe line for a purging fluid for cleaning a papermaking screen 5 (hereinafter described); 8, a suction pipe line; 70, a compressor; 80, a suction pump; and V1 through V8, on-off valves for the feed pipe and the suction pipe.

As shown in FIG. 1, the papermaking mold 1 is formed of a pair of splits 10 and 11 each having a large number of purging fluid flow passageways 2 which interconnect the inside and the outside of the cavity C, a manifold 3 which connects to the feed inlets of these flow passageways 2, suction passageways 4 (see FIG. 2) for discharging the liquid component of a pulp slurry charged into the cavity C, and a papermaking screen 5 for trapping the solid component of the pulp slurry. Because the splits 10 and 11 have the same basic structure, the following description refers only to the split 10, the description for the other split 11 omitted.

Figure 2B:
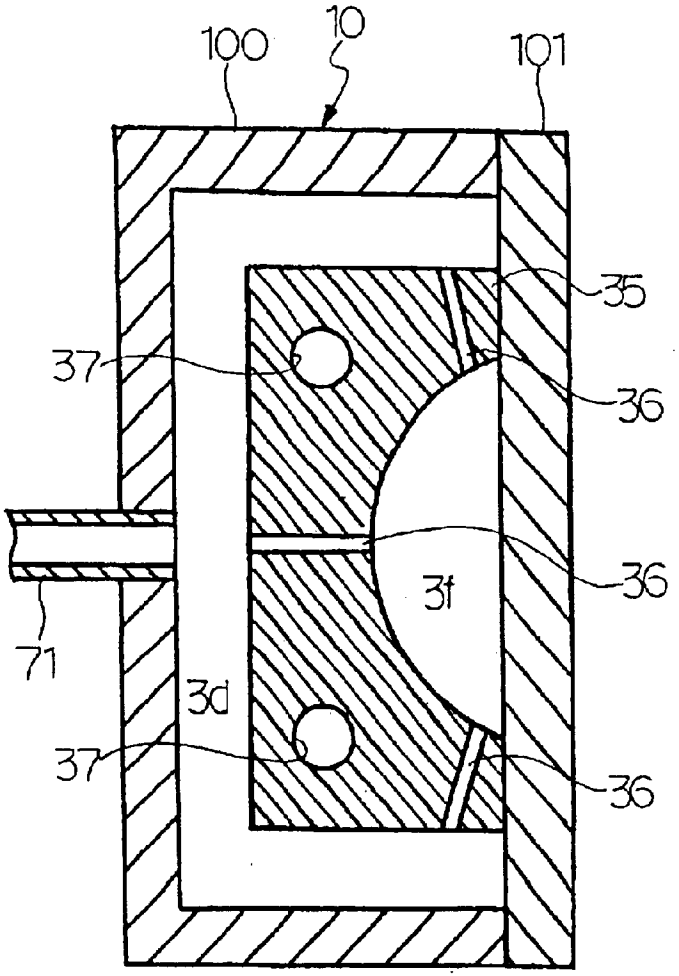
FIGS. 2(*a*) and (*b*) are horizontal cross-sections schematically showing the internal structure of a split forming the papermaking mold for pulp molded article production according to the present invention, in which FIG. 2(*a*) is a view on arrow A—A of FIG. 1, and FIG. 2(*b*) is a view on arrow B—B of FIG. 1, each of the split.
Figure 2A:
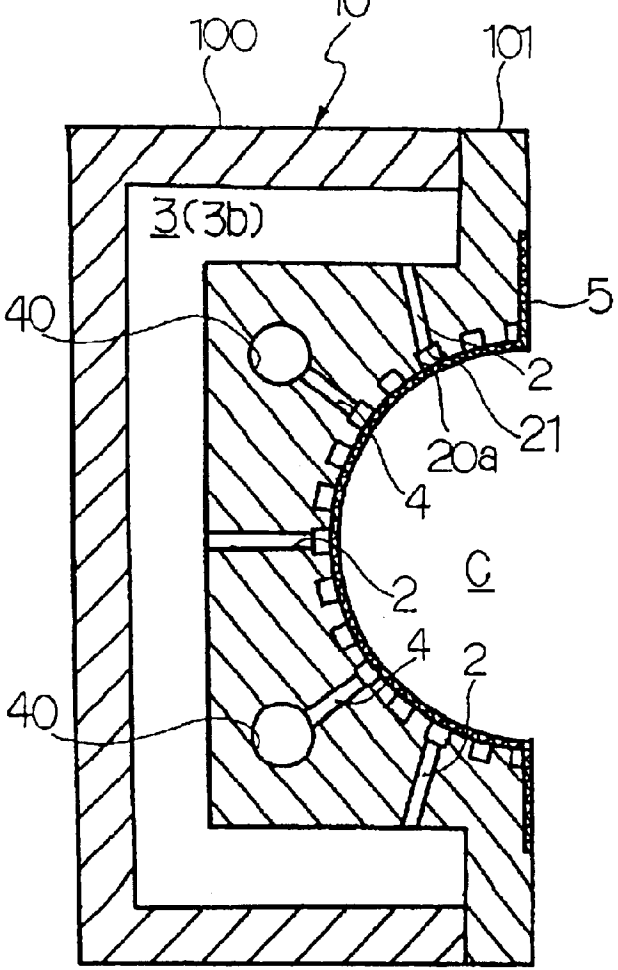
Figure 3A:
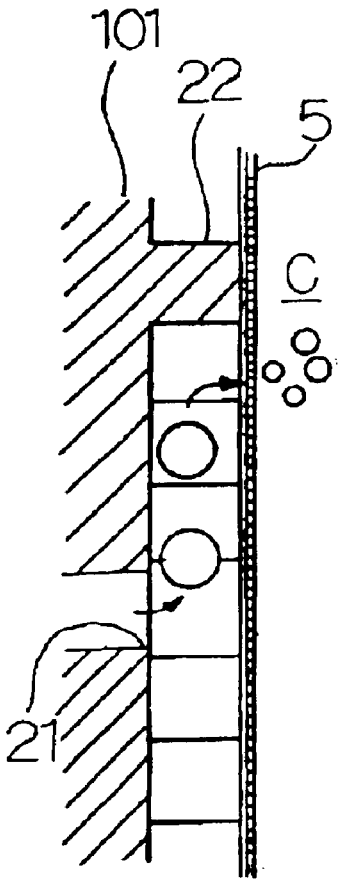
FIGS. 3(*a*) and (*b*) show the configuration of flow channels formed on the inner side of the split, in which FIG. 3(*a*) is a schematic, partial vertical cross-section of the split, and FIG. 3(*b*) schematically illustrates the arrangement of the flow channels on the inner side of the split.
Figure 3B:
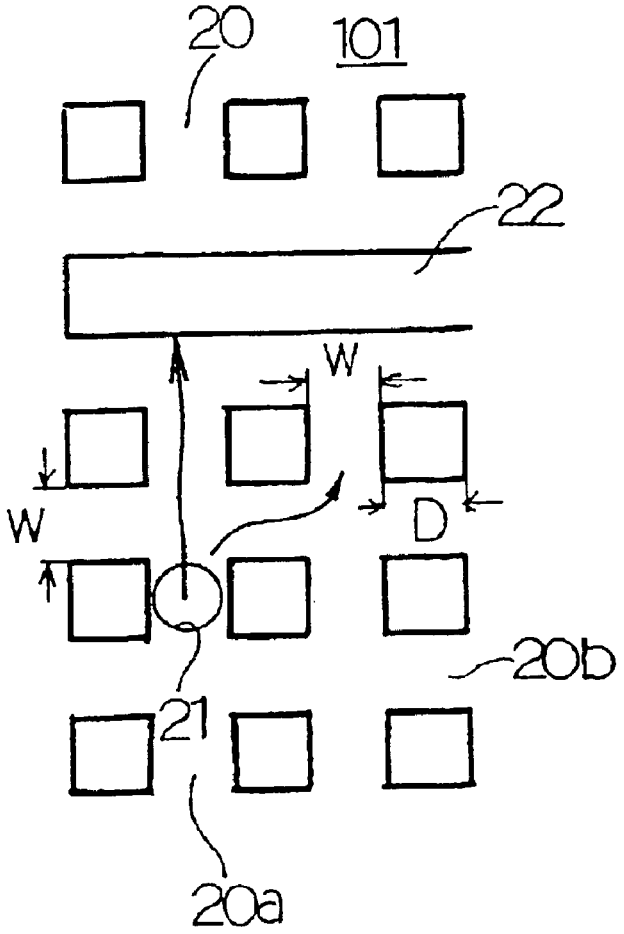

As shown in FIGS. 2 and 3, the split 10 mainly comprises an outer frame 100 and a papermaking block 101 which forms the cavity C. The manifold 3 is formed of the outer frame 100 and the papermaking block 101.

Flow channels 20 are provided on the inner side of the split 10, i.e., the inner side of the papermaking block 101 so that a purging fluid may flow broadly over almost the whole area of that side. The flow channels 20 extend vertically and horizontally in a check pattern. The vertically extending flow channels will be called "vertical channels", and the horizontally extending ones will be called "horizontal channels". The ejection outlet 21 of each flow channel 2 is made in a vertical channel 20*a*. The depth of the flow channels is preferably 0.5 to 100 mm, still preferably 1 to 50 mm, from the viewpoint of ease of channel forming, capability of discharging water, and prevention of clogging of the papermaking screen. The width W (see FIG. 3(*b*)) of the flow channels is preferably 0.3 to 25 mm, still preferably 1 to 10 mm, from the viewpoint of ease of channel forming, capability of discharging water, prevention of clogging of the papermaking screen, and capability of supporting the papermaking screen. The vertical channels 20*a* and the horizontal channels 20*b* may have different widths. The distance D between the channels is preferably 0.6 to 100 mm, still preferably 2 to 50 mm, in view of ease of channel forming, capability of discharging water, prevention of clogging of the papermaking screen, and capability of supporting the papermaking screen.

As shown in FIG. 3, ridges 22 are provided on the inner side of the papermaking block 101 to restrict the vertical flow of the purging fluid. The ridges 22 are evenly spaced in the vertical direction of the papermaking block 101 and each extend over the whole inner curved surface of the papermaking block 101. The positions of the ridges 22 in the vertical direction are set where clogging tends to occur. The ejection outlets 21 and the ridges 22 being so arranged, the purging fluid can be effectively ejected toward the inside of the cavity C. The split itself can be made of such materials as metals, resins and rubbers, particularly elastic materials which are not swollen with liquid components and have durability.

As shown in FIG. 1, the vertical channels 20*a* and the horizontal channels 20*b* are deeper in the upper part, that is, the portion corresponding to the vicinities of the opening of a molded article than in the lower part. With such a larger depth of the flow channels 20, the capacity in the upper part inclusive of the flow channels 20 in that part is made larger than that of the lower part. As a result, the ejected purging fluid is allowed to escape to the flow channels, and the liquid level of the pulp slurry is maintained high.

As shown in FIG. 1, the manifold 3 is partitioned into 5 chambers (3*a* to 3*e*) by partitioning walls 31 to 35 depending on the height of a molded article to be produced. The chamber 3*d* is divided by a partitioning wall 35 to provide a chamber 3*f* under the bottom of the cavity C. The partitioning wall 35 has flow passageways 36 and suction passageways 37 (see FIG. 2(*b*)). The flow passageways 36 interconnect the chamber 3*d* and the chamber 3*f* The two suction passageways 37 connect to two main suction passageways 40 (see FIG. 2(*a*), hereinafter described) made through the papermaking block 101. The chambers 3*b*, 3*c*, and 3*d* have feed pipes 73, 72, and 71 (parts of these feed pipes are depicted in a solid line for the sake of convenience), respectively, so that the purging fluid may be fed independently. The feed pipes 73, 72, and 71 are provided with the respective valves V3, V2, and V1 so that the purging fluid may be fed to the respective chambers under different pressures. This makes it possible that, when the purging fluid is fed in the initial stage of charging a pulp slurry, where the amount of the pulp slurry in the cavity is still small, the purging fluid is prevented from being ejected concentratedly from the ejection outlets at positions where the liquid level of the slurry has not yet reached. As a result, the force of the purging fluid can be maintained to produce a high cleaning effect. Further, it is also possible to concentrate the purging fluid at positions where clogging tends to occur thereby producing an enhanced cleaning effect.

On the other hand, a suction pipe 81 is connected to the chamber 3*a*. As will be described later, the suction pipe 81 connected to the chamber 3*a* performs discharge of water and gas during charging with a pulp slurry and ejecting a purging fluid in the papermaking step and facilitates charging a pulp slurry smoothly through the upper opening of the papermaking mold 1. A suction pipe 83 is connected to the chamber 3*e*. As will be described later, the liquid component of a pulp slurry fed into the cavity C is discharged through the suction pipe 83. In the present embodiment, a suction pipe 82 is connected to the feed pipe 71 so that the chamber 3*d* can be sucked where necessary.

The suction passageways 4 are provided inside the papermaking block 101 independently of the purging fluid flow passageways as shown in FIGS. 1 and 2(*a*). That is, the suction passageways 4 connect to the two main suction passageways 40 which vertically extend through the papermaking block 101 . The main suction passageways 40 connect to the suction passageways 37 shown in FIG. 2(*b*), and the suction passageways 37 connect to the chamber 3*e* shown in FIG. 1. The liquid component of the pulp slurry fed into the cavity C is discharged through the suction passageways 4, the main suction passageways 40, the suction passageways 37 , the chamber 3*e*, and the suction pipe 83. While in the present embodiment the chamber 3*a* has only the suction pipe 81 connected thereto, a feed pipe for a purging fluid may be connected to the chamber 3*a* so that the purging fluid may be ejected from the chamber 3*a*.

The papermaking screen 5 is fixed to the inner side of the split 10 with fastening screws (not shown). The manner of fixing the papermaking screen 5 is not limited to this. For example, the ends of the papermaking screen are sandwiched in between the papermaking block and the outer frame and fixed with fastening screws.

The papermaking screen 5 includes screens made of natural fibers, synthetic fibers or metal fibers, which can be used either individually or as a combination of two or more thereof. Screens fabricated of a combination of these fiber materials are also useful. In order to improve slip properties and durability, the fiber of the papermaking screen 5 is preferably subjected to surface treatment.

The natural fibers include plant fibers and animal fibers. The synthetic fibers include fibers of thermoplastic resins, thermosetting resins, or semisynthetic resins. The metal fibers include stainless steel fiber and copper fiber.

The papermaking screen 5 preferably has an average opening area ratio of 20 to 90%, particularly 30 to 60%, to avoid intimate contact with the inner side of the split and thereby maintain satisfactory suction efficiency. The papermaking screen 5 preferably has an average maximum opening width of 0.05 to 1 mm, particularly 0.2 to 0.5 mm, to securely perform papermaking while suppressing the solid component of the pulp slurry from passing through the screen or clogging the screen.

While not shown in the drawings, the pipes having the valves V1 to V6 have their several flow meters (not shown). The detection output from each of the attached flow meters is inputted in the control (not shown) of the molding apparatus, which operates according to a prescribed sequence to send control instructions, with which each valve is switched on and off.

Figures 4A, 4B, 4C:
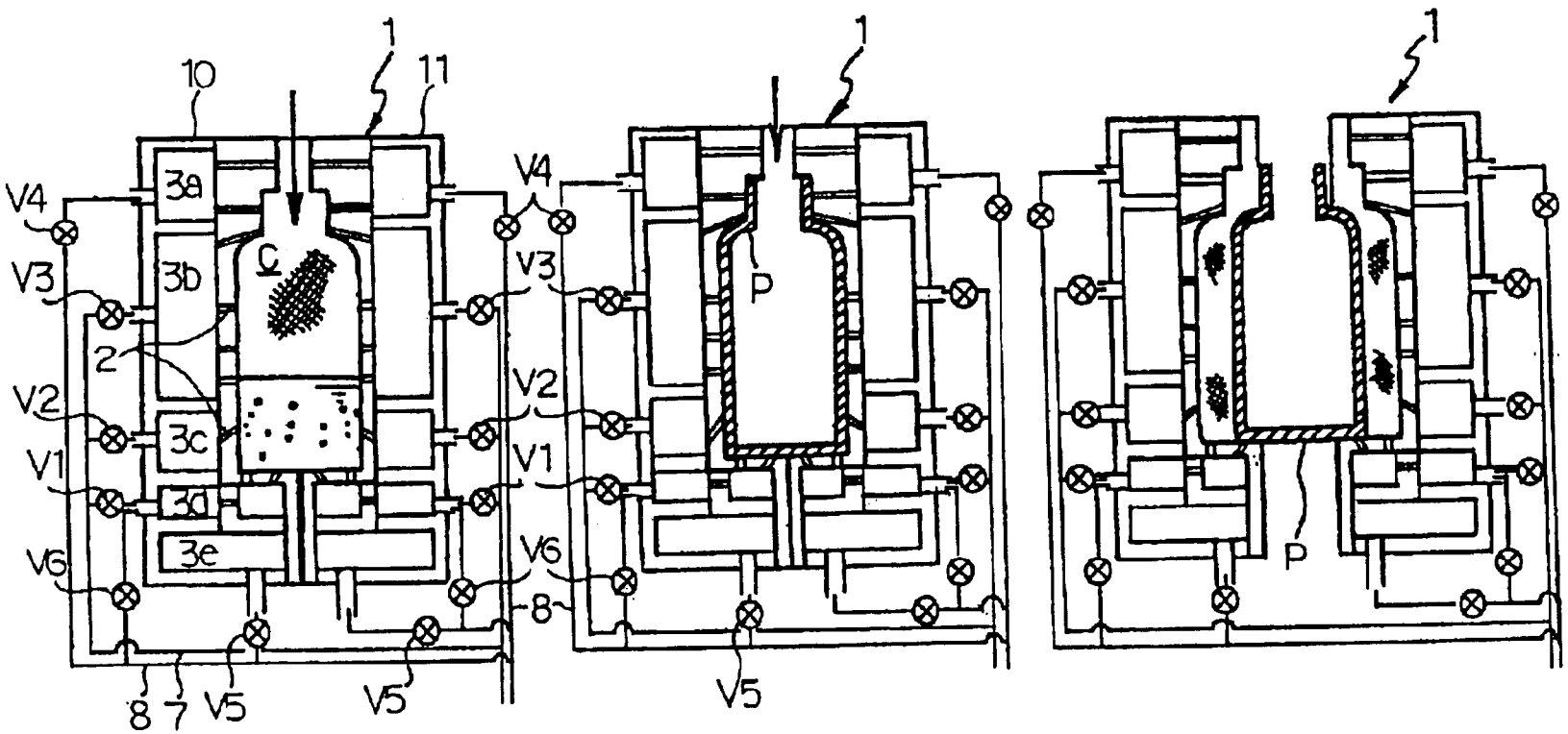
FIGS. 4(*a*) to (*c*) schematically show the flow of steps in the method of producing a pulp molded article according to the present invention, in which FIG. 4(*a*) is the step of charging a slurry, FIG. 4(*b*) is the step of dewatering, and FIG. 4(*c*) is the step of removal from mold.

The method of producing a pulp molded article according to the present invention will be described based on an embodiment using the aforementioned papermaking mold 1 as a preferred embodiment of the method with reference to the accompanying drawings. In FIG. 4, the papermaking mold 1 is depicted with part of which omitted for the sake of convenience.

First of all, the splits 10 and 11 are assembled into the papermaking mold 1 as shown in FIG. 4(*a*). In this state, the compressor 70 and the suction pump 80 are operated with the valves V2, V3, and V5 closed and the valves V7, V8, V1, and V4 open. Thus, a purging fluid is fed only to the chamber 3*d* of the manifold 3, and the chamber 3*a* is evacuated to smooth the filling with a pulp slurry.

An injection pump (not shown) is started to suck up a pulp slurry from a pulp slurry tank (not shown) and the slurry is fed into the cavity C from the upper opening of the papermaking mold 1.

The pulp slurry to be fed comprises pulp as a main solid component dispersed in water as a liquid component. The solid content may consist solely of pulp or may have other solid components added to the pulp. The proportion of the other solid components is 1 to 70% by weight, particularly 5 to 50% by weight. The other solid components include inorganic substances such as talc and kaolinite, inorganic fibers such as glass fiber and carbon fiber, particulate or fibrous synthetic resins such as polyolefins, non-wood or plant fibers, and polysaccharides. The liquid content may consist solely of water or may have other liquid components mixed therewith.

While the pulp slurry is being fed, a purging fluid running through the flow passageways 2 is ejected from the outer side of the papermaking screen toward the cavity C. While the purging fluid is passing through the papermaking screen 5, the pulp that has clogged the papermaking screen 5 in the preceding papermaking step is purged and mixed into the pulp slurry being fed. As shown in FIG. 3(*a*), since the ridges 22 provided on the split restrict the upward flow of the purging fluid through the vertical channels 20*a*, the purging fluid is vigorously fed to the inside of the cavity C.

In the present embodiment, the valves V1 to V3 fitted to the purging fluid feed pipes 71 to 73 of the papermaking mold 1 are opened simultaneously or, it is preferred that they are successively opened in the order of V1, V2, and V3 synchronously with the amount of the fed pulp slurry (liquid level).

Because the papermaking mold 1 allows the purging fluid to be fed independently into each of the divided chambers, the purging fluid can be ejected into the pulp slurry with vigor and without waste.

Further, the feed piping system provided with valves allows the purging fluid to be fed into the chambers under different pressures. This makes it possible to concentrate purging to the parts where clogging tends to occur thereby to achieve an increased cleaning effect.

Furthermore, because the vertical channels 20*a* and the horizontal channels 20*b* are deeper in the upper part, e.g., the part corresponding to the vicinities of the opening of a molded article, even if bubbles generated by the purging fluid gather in the upper part, the liquid level can be maintained high. As a result, the papermaking screen 5 is effectively cleaned.

While not particularly limiting, air is the most preferred purging fluid to be ejected from the standpoint of cost, ease of handling, and the like. A liquid component may be ejected in place of air, or a mixture of a liquid component and air may be ejected. While the liquid component to be mixed is not particularly limited, the liquid component of the pulp slurry is the most preferred from the standpoint of ease of handling, production cost, simplification of equipment (i.e., the same piping can serve for feeding the purging fluid and for water discharge and suction), and the like. The ejection volume and time of the purging fluid are decided appropriately so as to accomplish sufficient cleaning through previous testing according to the shape, etc. of a molded article to be produced.

Then, as shown in FIG. 4(*b*), the valves Vito V3 and the valve V7 (root valve, see FIG. 1) of the purging fluid feed pipe line 7 are closed, and the valves V5 and V6 of the suction pipe line 8 are opened. The cavity C is evacuated by suction from the outside of the papermaking mold 1 through the suction passageways 4 and the water of the pulp slurry is discharged out of the cavity C while pulp fibers are deposited on the inner side of the papermaking screen 5. The pressure of the pressurizing air feed is decided appropriately according to the molded article. As is understood from the above description, the part of the papermaking screen 5 located on the chamber 3*a* of the manifold 3 keeps sucked for a longer time than the other part. As a result, the pulp layer deposited on this part gains more thickness than on the other part.

On forming a pulp layer P with a prescribed thickness, pulp slurry injection is stopped, and suction of the cavity C is continued to carry out dewatering.

In the step of dewatering, a pressurizing fluid is fed into the cavity C as shown in FIG. 4(*b*) while continuing evacuation of the cavity C by suction through the suction pipe line 8. The pressurizing fluid includes air and steam. Air is the most preferred for ease of handling and cost. The pressure of the pressurizing fluid to be fed is preferably 0.05 to 1 MPa, still preferably 0.2 to 1 MPa.

After the pulp layer P is dewatered to a prescribed water content, all the valves are closed, and the papermaking mold 1 is opened as shown in FIG. 4(*c*) to take out a wet molded article precursor (undried molded article) having the prescribed water content.

The precursor thus taken out is subjected to the step of heat drying. In carrying out the heat drying step, a drying mold is used, which is composed of a pair of splits (with no papermaking screen disposed) butted together to form a cavity in conformity with the contour of a molded article to be produced. The drying mold is heated to a predetermined temperature, and the precursor in a wet state is fitted into the drying mold. It is preferred to use a drying mold having suction passageways interconnecting the cavity and the outside of the drying mold for obtaining improved drying efficiency.

A hollow, elastic and extensible pressing member is then inserted into the precursor fitted into the cavity. The pressing member is used in its inflated state like a balloon in the cavity to press the pulp layer to the inner wall of the cavity of the drying mold thereby to transfer the inner profile of the drying mold cavity to the pulp layer and to perform press drying the pulp layer. The pressing member is made of fluororubber, silicone rubber, elastomers, etc., which are excellent in tensile strength, impact resilience, and stretchability.

A pressurizing fluid is fed into the pressing member to expand it while evacuating the cavity by suction through the suction passageways of the drying mold. The expanded pressing member presses the pulp layer to the inner wall of the cavity of the drying mold. Whereupon, the pulp layer is pressed onto the inner wall of the papermaking screen by the expanded pressing member 6, the inner profile of the drying mold cavity is transferred to the pulp layer, and drying further proceeds. Since the precursor is pressed from its inside against the inner wall of the drying mold cavity, the inner profile of the cavity is transferred to the surface (outer surface) of the pulp layer with good precision however complicated the inner cavity profile may be, and the resulting molded article is to have sufficiently increased strength in the thick-walled portion near the upper opening thereof Besides, because there is involved no step of joining separately formed parts unlike a conventional method of producing pulp moldings, the resulting molded article has no seams nor thick-walled parts due to joining. As a result, the resulting molded article has secured strength and a satisfactory appearance. The pressurizing fluid for expanding the pressing member includes compressed air (heated air), oil (heated oil) and other various liquids. The pressure for feeding the pressurizing fluid is preferably 0.01 to 5 MPa, particularly 0.1 to 3 MPa.

After the profile of the inner wall of the drying mold cavity is sufficiently transferred to the pulp layer, and the pulp layer is dried to a prescribed water content, the pressurizing fluid is withdrawn from the pressing member to let the pressing member shrink. The shrunken pressing member is removed from the cavity, and the drying mold is opened to take out a molded article having been dried to a prescribed degree.

The molded article thus produced does not particularly need a plastic member for reinforcement. Therefore, the cost of production is low and, the molded article after use is easily recyclable or incinerable, which leads to waste reduction.

The papermaking mold 1 for pulp molded article production according to this embodiment and the method of producing a pulp molded article by use of this papermaking mold enable cleaning of a papermaking mold in the line for molded article production without altering the production cycle. As a result, the production efficiency is greatly increased over conventional techniques.

Figure 5:
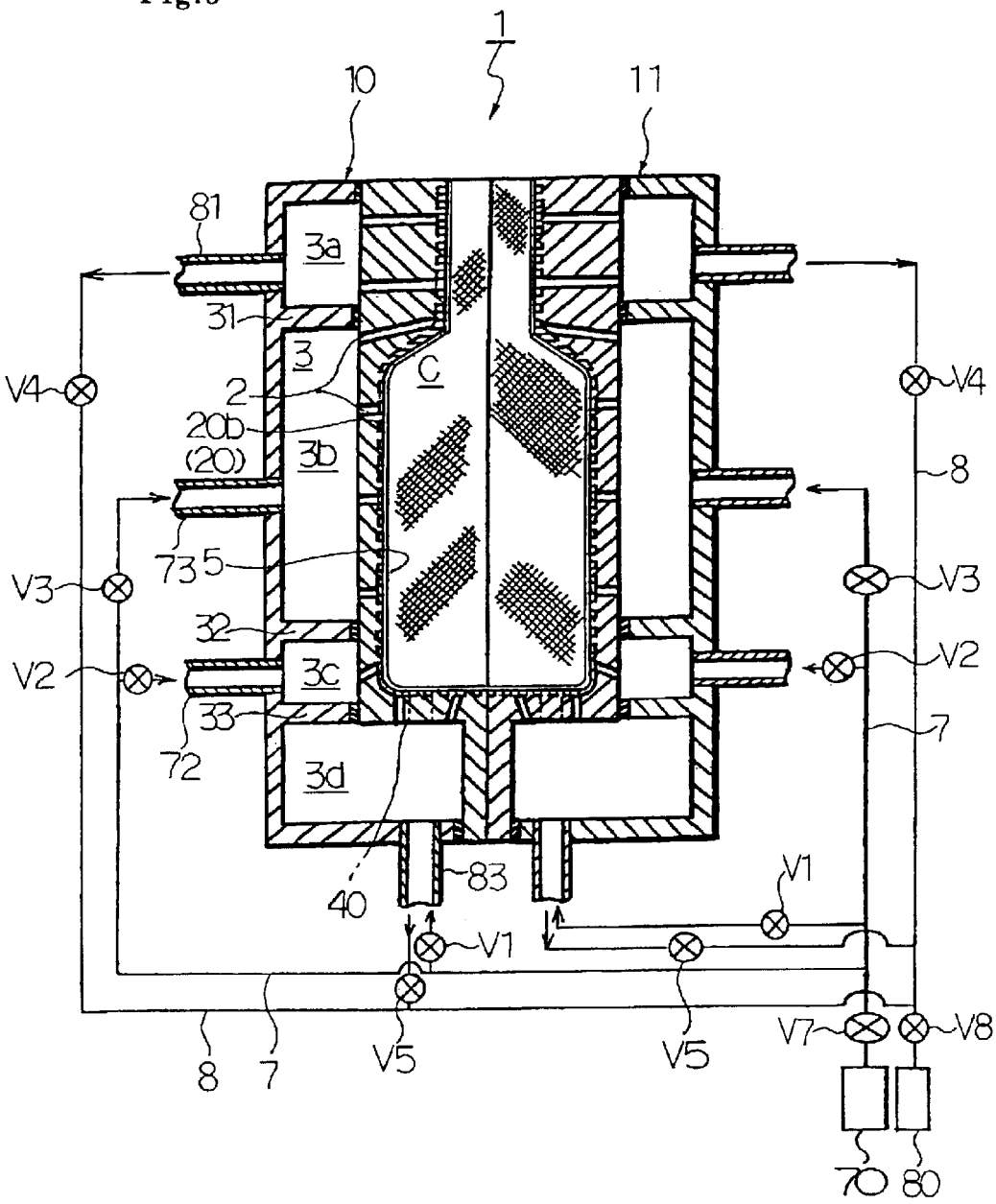
FIG. 5 is a schematic view (corresponding to FIG. 1) representing another embodiment of the papermaking mold for pulp molded article production according to the present invention.

FIG. 5 represents another embodiment of the papermaking mold for pulp molded article production according to the present invention. The papermaking mold 1 according to this embodiment is basically the same in structure as the aforementioned papermaking mold 1, except for the number of divided chambers of the manifold and the piping system for the feed pipes, suction pipes, and valves accordingly. In what follows, the papermaking mold 1 will be described with respect only to the differences from the aforementioned papermaking mold 1, and description of the members common to them, which are given the same numerical references, is omitted. Accordingly, the description of the above-described embodiment is to apply appropriately to the particulars not referred to hereunder.

As shown in FIG. 5, the papermaking mold 1 according to the present embodiment has a branch of the purging fluid suction pipe line 7 connected to a feed pipe 83 of a chamber 3*d* of the manifold 3. In this structure, while the cavity C is being filled with a pulp slurry with the valves V7, V8, V1, and V4 open and the valves V2, V3, and V5 closed, a purging fluid is ejected from almost the entire inner surface of the cavity C through the flow passageways 2, the main suction passageways 40, and the suction passageways 4 (see FIG. 2(*a*)) which are all connected to the chamber 3*d*, thereby to achieve effective cleaning. According to necessity, the valves V2 and V3 can be opened to increase the area for feeding the purging fluid. After a prescribed amount of the pulp slurry has been fed into the cavity C, the valves V1 to V3 are closed, and the valve V5 is opened to discharge the water content of the pulp slurry through the suction passageways 4, the main suction passageways 40, and the chamber 3*d* to carry out papermaking.

The present invention is by no means limited to the above-mentioned embodiments, and modifications can appropriately be made therein without departing from the spirit and scope thereof.

While the present invention is preferably used in the manufacture of hollow molded articles by pouring a pulp slurry into the cavity as in the above-described embodiments, it is also applicable to, for example, a method of producing a pulp molded article in which the papermaking mold 1 inverted upside down (with its opening facing down) is put in a tank filled with a pulp slurry, and the pulp slurry in the cavity is sucked up and dewatered to form a pulp layer.

Figures 6A, 6B, 6C:
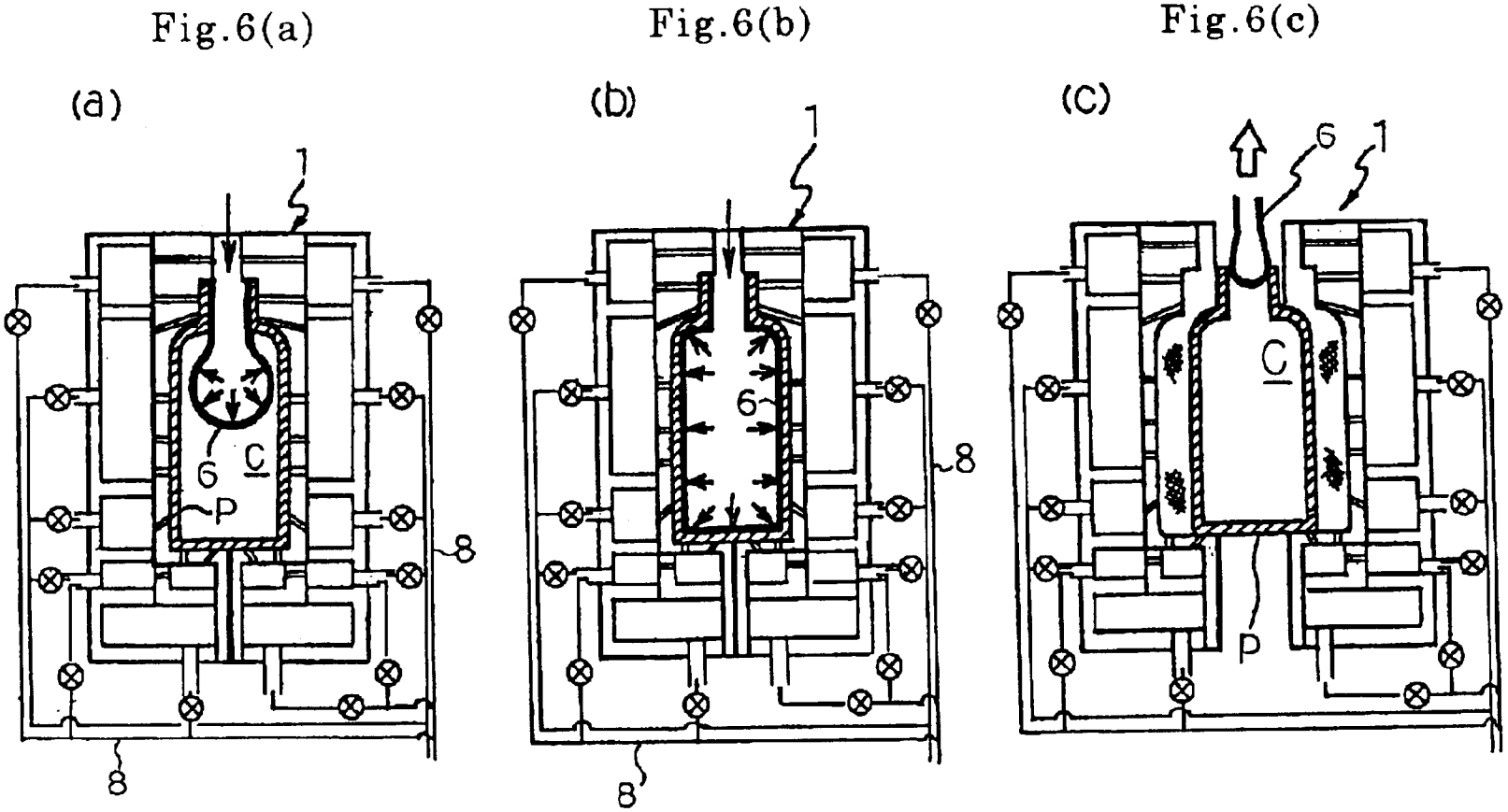
FIGS. 6(*a*) to (*c*) schematically show another flow of dewatering followed by removal from mold in the method of producing a pulp molded article according to the present invention, in which FIG. 6(*a*) is the step of inserting a pressing member, FIG. 6(*b*) is the step of press dewatering with the pressing member, and FIG. 6(*c*) is the step of removing the pressing member and opening the mold.

In the present invention, while dewatering is preferably carried out by feeding a pressurizing fluid (e.g., air) into the cavity as in the aforementioned embodiment, dewatering can also be effected by using a pressing member as shown in FIG. 6 to impart high shape retention to the dewatered molded article.

That is, after a molded article is obtained by papermaking as described in the above-described embodiment (see FIG. 4(*a*)), a hollow, elastic and stretchable pressing member 6 is inserted into the cavity C as shown in FIG. 6(*a*) while evacuating the cavity C by suction through the suction pipe line 8 of the papermaking mold 1.

A pressurizing fluid is fed into the pressing member 6 to expand it while continuing evacuation of the cavity C by suction through the suction pipe line 8 as shown in FIG. 6(*b*). The expanded pressing member 6 presses the pulp layer P to the inner side of the papermaking screen 5. The pulp layer P is thus pressed by the expanded pressing member 6 onto the inner side of the papermaking screen 5. As a result, the inner profile of the papermaking mold 1 is transferred to the pulp layer P, and dewatering proceeds further.

According to this embodiment, since the pulp layer P is pressed from the cavity C side to the inner side of the papermaking screen 5, the inner profile of the papermaking mold 1 is transferred to the surface (outer surface) of the pulp layer P with good precision however complicated the inner cavity profile may be. The pressurizing fluid that can be used to expand the pressing member 6 includes compressed air (heated air), oil (heated oil) and other various liquids. The pressure for feeding the pressurizing fluid is preferably 0.01 to 5 MPa, particularly 0.1 to 3 MPa.

After the inner profile of the papermaking mold 1 is sufficiently transferred to the pulp layer P, and the pulp layer P is dewatered to a prescribed water content, the valves are closed, and the pressurizing fluid is withdrawn from the pressing member 6 as shown in FIG. 6(*c*), whereupon the pressing member 6 shrinks automatically to its original size. The shrunken pressing member 6 is removed from the cavity C. The papermaking mold 1 is opened to take out a wet molded article precursor (undried molded article) having the prescribed water content.

The present invention is also applicable to production of a molded article having a plurality of different pulp layers. In this application, it is preferred to supply the purging fluid while feeding of the pulp slurry to fabricate the outermost layer.

The time of starting to eject the purging fluid is not particularly limited provided that the purging fluid is ejected during charging with a pulp slurry. It is desirable that the purging fluid ejection has been started before starting pulp slurry charging as in the above-described embodiment. It is a matter of course that the purging fluid ejection may be started simultaneously with or after the start of pulp slurry charging.

Figure 7:
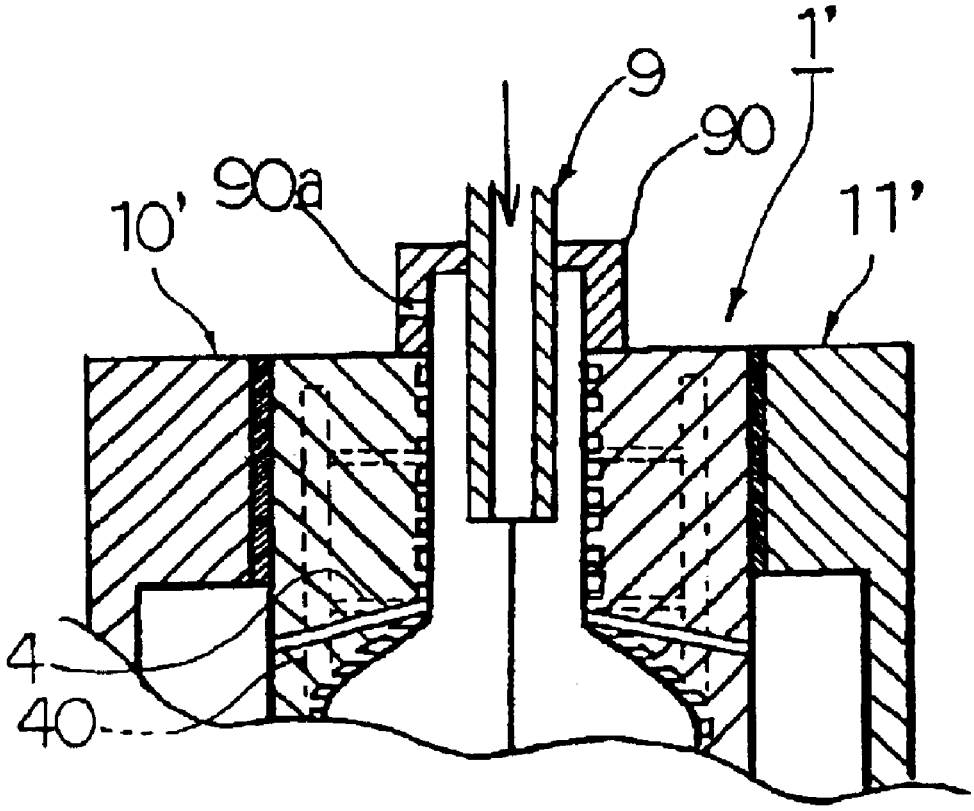
FIG. 7 is a partial enlarged cross-section representing another embodiment of a system for discharging water and gas.

While the papermaking mold 1 used in the above-described embodiment is composed of the splits 10 and 11 each having the suction pipe 81 connected to the chamber 3*a* as a water and gas discharge passageway for facilitating smooth feed of a pulp slurry, feed of a pulp slurry can also be conducted by using, for example, a papermaking mold 1' as shown in FIG. 7, which is formed of splits 10' and 11' having the same structure as the splits 10 and 11, except that a chamber corresponding to the chamber 3*a* is not provided. In this case, a member 90 having a passageway 90*a* is fitted around a nozzle 9 for feeding a pulp slurry. A pulp slurry is fed through the nozzle 9 inserted to a prescribed position in the cavity while discharging water and gas through the passageway 90*a* to generate a flow of the pulp slurry in the vertical direction of the cavity. As a result, a molded article with uniform thickness is formed, and pulp is easily deposited on the portion corresponding to the neck of a molded article (hollow container).

Figure 8:
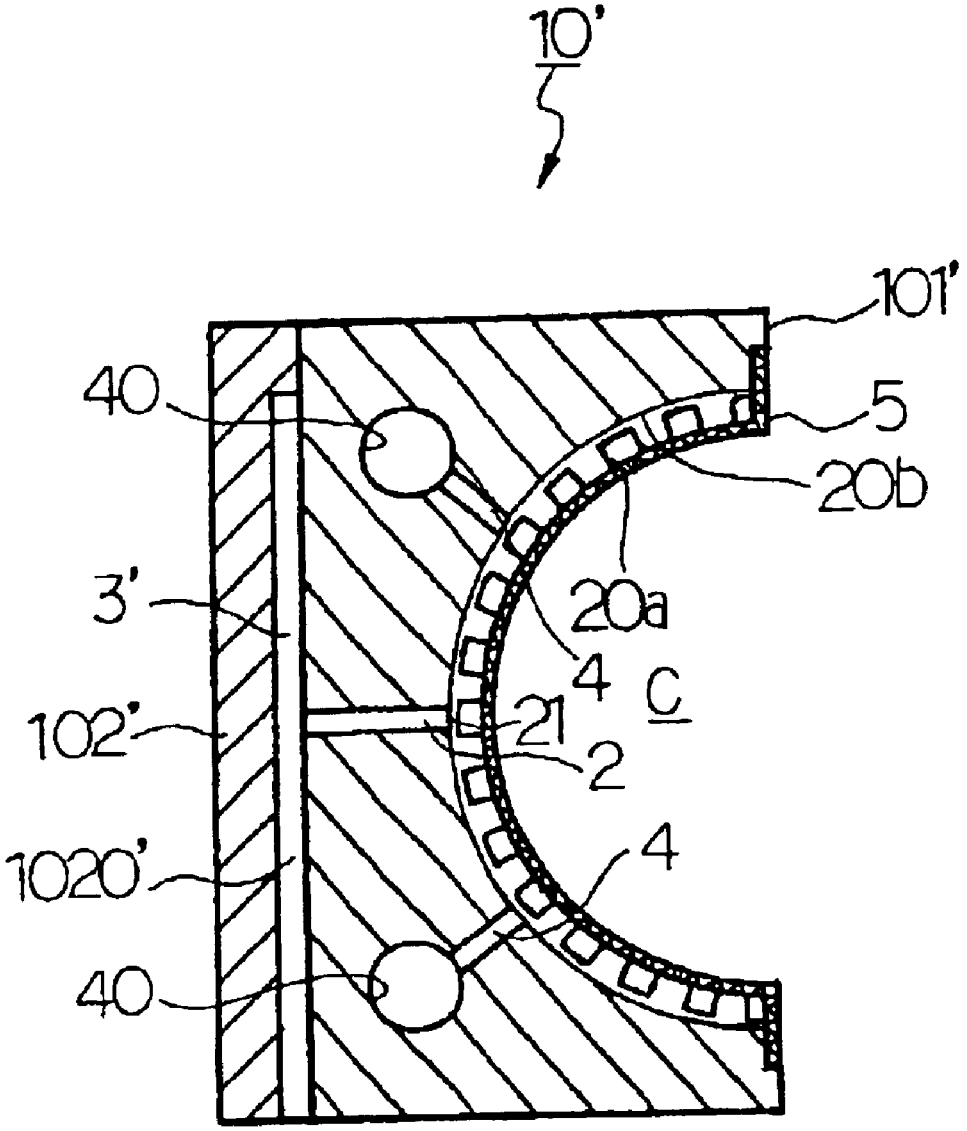
FIG. 8 is a schematic, partial cross-section (corresponding to FIG. 2(*a*)) representing still another embodiment of the papermaking mold for pulp molded article production according to the present invention.

The papermaking mold of the present invention is preferably such that the split 10 forming the papermaking mold 1 is composed of the outer frame 100 and the papermaking block 101 with the manifold 3 formed therebetween as in the above-described embodiment, the papermaking mold may have the structure shown in FIG. 8. In FIG. 8 members common to the above-described papermaking mold are given the same numerical references, and description therefor is omitted. Accordingly, the description of the papermaking mold 1 of the above-described embodiment applies appropriately to the particulars not referred to hereunder.

The split 10' shown in FIG. 8 forming a papermaking mold is composed of a papermaking block 101' and a plate-shaped surface member 102' which is disposed on the back side of the papermaking block 101'. A flow channel 1020' is formed on the back side of the papermaking block 101' or on the surface member 102' to provide a manifold 3' connecting to the feed inlet of the flow passageway 2. The papermaking mold according to this embodiment exhibits compactness and ease of handling as well as the effects of the papermaking molds of the above-described embodiments.

While the papermaking mold according to the present invention is suited to the manufacture of hollow, closed-end cylindrical molded articles as in the aforementioned embodiments, it is modifiable to shapes of containers, such as hollow, closed-end cylindrical molded articles having an elliptic cross-section.

INDUSTRIAL APPLICABILITY

The method of producing a pulp molded article according to the present invention enables cleaning a papermaking mold in the production line and thereby achieves greatly improved production efficiency over the conventional techniques.

The papermaking mold for pulp molded article production according to the present invention makes it possible to conveniently carry out the method of producing a pulp molded article according to the present invention.

What is claimed is:

1. A method of producing a pulp molded article comprising the steps of assembling a plurality of splits each having a papermaking screen and a suction passageway into a papermaking mold, filling the cavity of said papermaking mold with a pulp slurry, discharging the liquid component of said pulp slurry through said suction passageway to deposit pulp fiber on the inner side of said papermaking screen into an undried wet molded article, and dewatering said undried molded article deposited on the inner side of the papermaking screen, which is characterized in that said splits each have one or more flow passageways for feeding a purging fluid for cleaning the papermaking screen and that said purging fluid is fed from the outer side of said papermaking screen toward the cavity through said flow passageways during the filling with the pulp slurry.

2. The method of producing a pulp molded article according to claim 1, wherein said undried molded article formed on the inner side of said papermaking screen is dewatered by feeding pressurizing air into the cavity.

3. A papermaking mold for pulp molded article production which is assembled from a plurality of splits to form a cavity, wherein said splits each have one or more flow passageways for a purging fluid that interconnect the cavity and the outside, a suction passageway for sucking the liquid component of the pulp slurry charged into the cavity, a papermaking screen trapping the solid component of the pulp slurry, and a feed pipe line for feeding the purging fluid which connects to said flow passageway, said feed pipe line having a valve which turns on and off under control so as to feed the purging fluid toward the cavity during the filling with the pulp slurry.

4. The papermaking mold for pulp molded article production according to claim 3, wherein flow channels for the purging fluid are provided on the inner side of each of said splits.

5. The papermaking mold for pulp molded article production according to claim 4, wherein said flow channels extend vertically and horizontally in a check pattern, and a ridge is provided on the inner side of each of said splits to restrict the upward flow of the purging fluid in said flow channels.

6. The papermaking mold for pulp molded article production according to claim 5, wherein said flow channels are deeper in the upper part than in the lower part of each of said splits.

7. The papermaking mold for pulp molded article production according to claim 3, wherein a plurality of said flow passageways and said feed pipe line are connected via a manifold, and said manifold is partitioned into a plurality of chambers, and said purging fluid is fed into each of said chambers independently.

8. The papermaking mold for pulp molded article production according to claim 7, wherein the plurality of chambers varies based on a height of the pulp molded article.

9. A method for producing a pulp molded article, comprising:

assembling a papermaking mold having a cavity from a plurality of splits, each of the plurality of splits including a papermaking screen and a suction passageway;

filling the cavity with a pulp slurry;

discharging a liquid component of the pulp slurry through a suction passageway, thereby depositing pulp fiber on an inner side of the papermaking screen to form a wet molded article;

dewatering the wet molded article; and feeding a purging fluid through at least one flow passageway during the filling step.

10. The method of producing a pulp molded article according to claim 9, wherein the dewatering step includes feeding pressurizing air into the cavity.

11. A papermaking mold for a pulp molded article, the papermaking mold comprising:

a plurality of splits configured to form a cavity and including at least one flow passageway interconnecting the cavity and an outside of the cavity;

at least one suction passageway configured to suck out a liquid component of a pulp slurry in the cavity;

a papermaking screen configured to trap a solid component of the pulp slurry; and a feed pipe line connected to the at least one flow passageway and configured to feed a purging fluid, wherein the feed pipe line includes a valve adapted to control a flow of purging fluid toward the cavity.

12. The papermaking mold according to claim 11, wherein the at least one flow channel is provided on an inner side of each of the plurality of splits.

13. The papermaking mold according to claim 11, wherein the at least one flow channel extends vertically and horizontally in a checkered pattern, and each of the plurality of splits includes a ridge provided on an inner side to restrict an upward flow of the purging fluid in the at least one flow channel.

14. The papermaking mold according to claim 11, wherein the at least one flow channel is deeper in an upper region than in a lower region of each of the plurality of splits.

15. The papermaking mold according to claim 11, wherein the at least one flow channel includes a plurality of flow channels connected via a manifold, and the manifold is partitioned into a plurality of chambers into each of which the purging fluid is independently fed.

16. The papermaking mold according to claim 15, wherein a number of the plurality of flow channels varies based on a height of the pulp molded article.

* * * * *